US005887308A

United States Patent [19]

Walter

[11] Patent Number: 5,887,308

[45] Date of Patent: Mar. 30, 1999

[54] EXPANSION JOINT SYSTEM WITH SEISMIC ACCOMMODATION

[75] Inventor: Wayne J. Walter, N. Tonawanda, N.Y.

[73] Assignee: Watson Bowman Acme Corp., Amherst, N.Y.

[21] Appl. No.: 901,364

[22] Filed: Jul. 28, 1997

[51] Int. Cl.[6] ..... F01D 19/06

[52] U.S. Cl. ..... 14/73.1; 404/56; 404/69; 52/396.04

[58] Field of Search ..... 14/73.1, 73.5, 14/78; 404/56–62, 69, 53; 52/396.04, 396.06, 396.08

[56] References Cited

U.S. PATENT DOCUMENTS

| | | | |
|---|---|---|---|
| 3,482,492 | 12/1969 | Bowman | 404/56 |
| 3,699,853 | 10/1972 | Wicks, III | 404/58 X |
| 4,075,728 | 2/1978 | Puccio | 14/73.1 |
| 4,339,214 | 7/1982 | Puccio et al. | 14/73.1 |
| 4,516,284 | 5/1985 | Huber et al. | 404/56 X |
| 4,923,328 | 5/1990 | Arps et al. | 404/69 |

*Primary Examiner*—James A. Lisehora
*Attorney, Agent, or Firm*—Rudnick & Wolfe; James P. Ryther, Esq.

[57] ABSTRACT

An expansion joint system which is designed to accommodate forces applied to highway construction during normal changes in ambient conditions, and which is also designed to withstand seismic forces which may be applied in transverse and longitudinal directions. The system comprises spaced-apart transverse beams which are placed in a gap defined between adjacent sections of highway construction such as in a bridge. Longitudinally extending support bars are positioned beneath the beams, and the ends of the bars are located in the interiors of boxes associated with the highway sections. One set of boxes confines bar ends against transverse movement but permits longitudinal movement. The other set of boxes permits the transverse movement but limits longitudinal movement.

8 Claims, 2 Drawing Sheets

EXPANSION JOINT SYSTEM WITH SEISMIC ACCOMMODATION

BACKGROUND OF THE INVENTION

This invention relates to expansion joints of the type utilized in highway construction wherein gaps are formed between sections, for example, during the construction of bridges. The gaps allow for expansion and contraction of the sections in response to changes in the ambient temperature.

Such bridges are also subject to relative movement in response to occurrence of seismic events. This raises particular problems because the movements occurring during such events are not predictable both with respect to the magnitude of the movements and with respect to the direction of the movements. In many instances bridges have become unusable for significant periods of time due to the fact that traffic cannot be moved across damaged expansion joints.

The difficulty in designing of such expansion joints is that when a movement component of large magnitude is applied transverse to the roadway direction, the joints are unable to resist damage. Attempts have been made to avoid this problem, as described, for example, in U.S. Pat. No. 4,674,912. This expansion joint system, which is sold by Maurer Sohne, GmbH, attempts to deal with the problem by using sliding and swiveling movements of the joint components to accommodate the non-longitudinal movements.

The "Steelflex" system offered by D. S. Brown Company utilizes a center beam which is individually attached to its own support bar. The support bars move parallel to the direction of movement of the structure.

The "Robek System" offered by Tech Star, Inc. includes modular joints designed to accommodate longitudinal movement. As with the other prior art systems, this design has not been proven effective to prevent significant damage under substantial seismic event conditions.

SUMMARY OF THE INVENTION

This invention constitutes an expansion joint system which is installed between sections of roadway as in a bridge construction. The components of the system comprise a plurality of support beams positioned in the gap between the roadway sections. These beams are positioned side-by-side and extend transversely relative to the direction of vehicle travel. The top surfaces of the beams are engaged by the vehicle tires.

Strip seals extend between the beams adjacent the tops of the beams to fill the spaces between the beams. These strip seals are flexible and therefore stretch and contract in response to beam movement. During severe transverse movement, such as during an earthquake, only minimum damage to the seals is likely.

A plurality of support bars extend beneath the beams and provide bearing surfaces for movement of the beams relative to the bars. Each end of the support bars is received in a box and the several boxes are embedded in the respective roadway sections. In accordance with the invention, provision is made for freedom of movement of the boxes relative to the support bars.

Specifically, boxes for receiving one end of the bars are designed to permit longitudinal movement of the boxes relative to those ends of the bars in response to changes in ambient temperature. Boxes for receiving the other ends of the bars are designed to permit relative transverse movement while confining the bars against relative longitudinal movement.

DESCRIPTION OF THE PREFERRED EMBODIMENT

Figure 1:
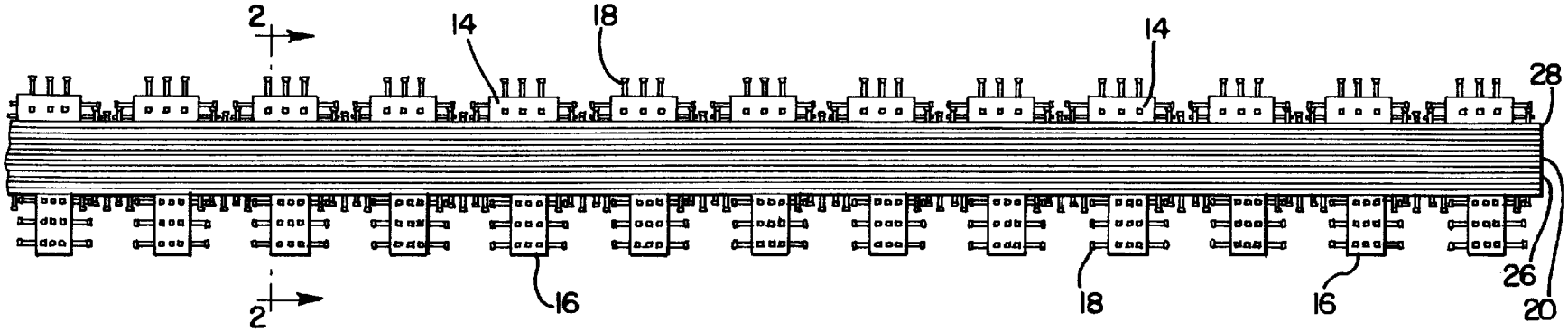
FIG. 1 is a top plan view illustrating the expansion joint system of the invention.
Figure 2:
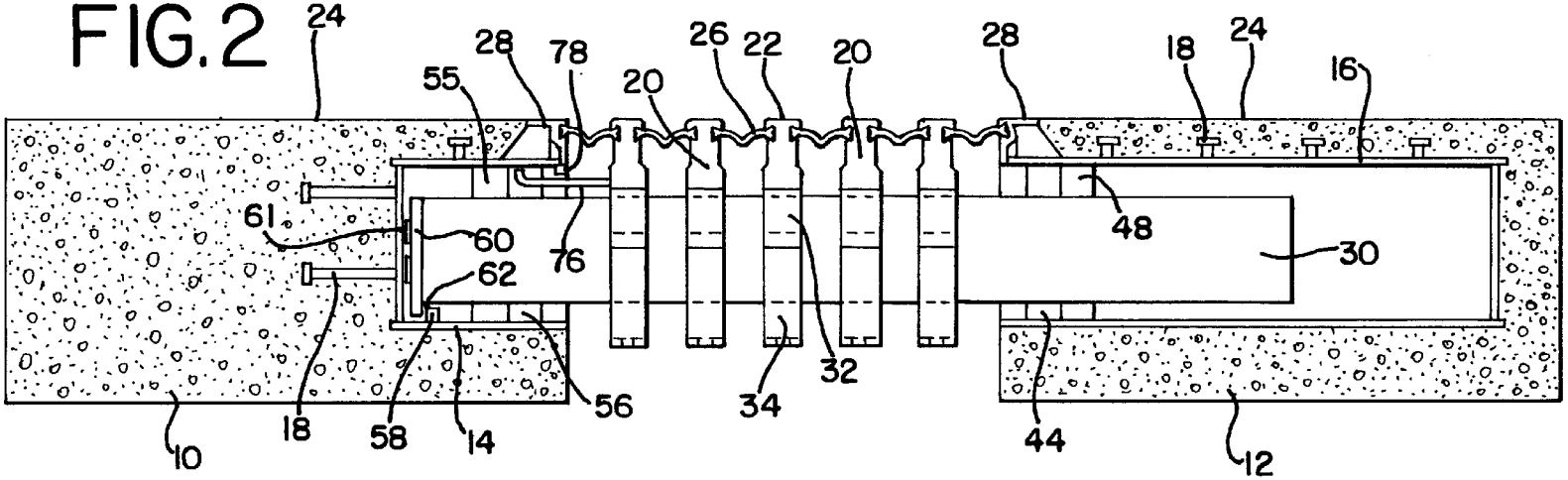
FIG. 2 is a horizontal cross-sectional view taken about the line 2—2 of FIG. 1.

FIG. 2 illustrates the expansion joint system of the invention in association with concrete emplacements 10 and 12. This concrete is typically poured into a blockout which has been formed in adjacent roadway sections. The expansion joint system employs boxes 14 and 16 which carry anchoring studs 18, and the boxes are located in the blockout prior to pouring whereby they become embedded in the concrete and securely anchored in place.

A plurality of support beams 20 are positioned in side-by-side relationship and extend transversely relative to the direction of roadway traffic. The top surfaces 22 of these beams are substantially in the same plane as the roadway surface 24.

Elongated strip seals 26 extend between the beams and are attached to the sides of the beams adjacent the upper ends thereof. These seals define enlarged side edges which are press fit within elongated channels defined in the sides of the beams. In conventional fashion, the strips will expand and contract as the beams move relative to each other. Steel shapes 28 extend parallel to the beams and are attached to the boxes 14 and 16 to provide attachment means for the edges of the outermost seals. The strip edges can pull away from the shape 28 associated with the box 14 under extreme transverse movement.

The boxes 14 and 16 define interiors which receive the respective ends of a plurality of support bars 30. The support bars extend in the direction of vehicle travel and loads applied by the vehicles are transferred from the beams 20 to the bars 30.

Figure 4:
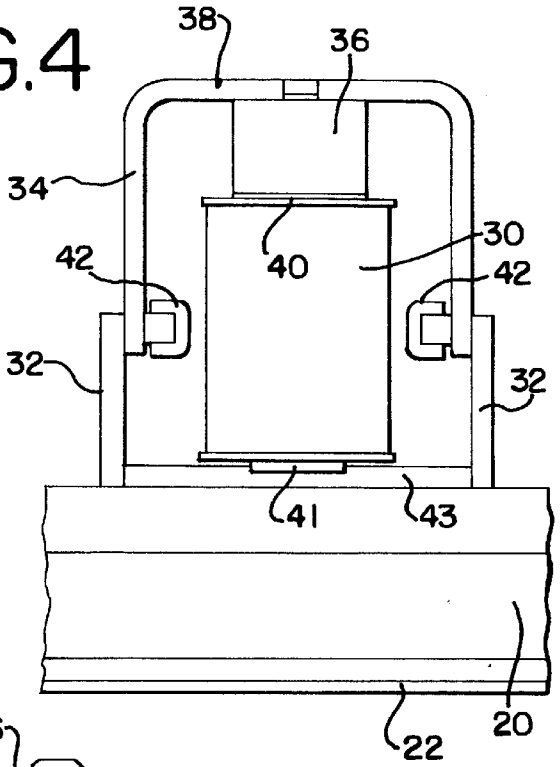
FIG. 4 is an enlarged fragmentary cross-sectional view taken about the line 4—4 of FIG. 3; and, FIG. 5 is a fragmentary cross-sectional view illustrating a confinement means for the system support beams.
Figure 3:
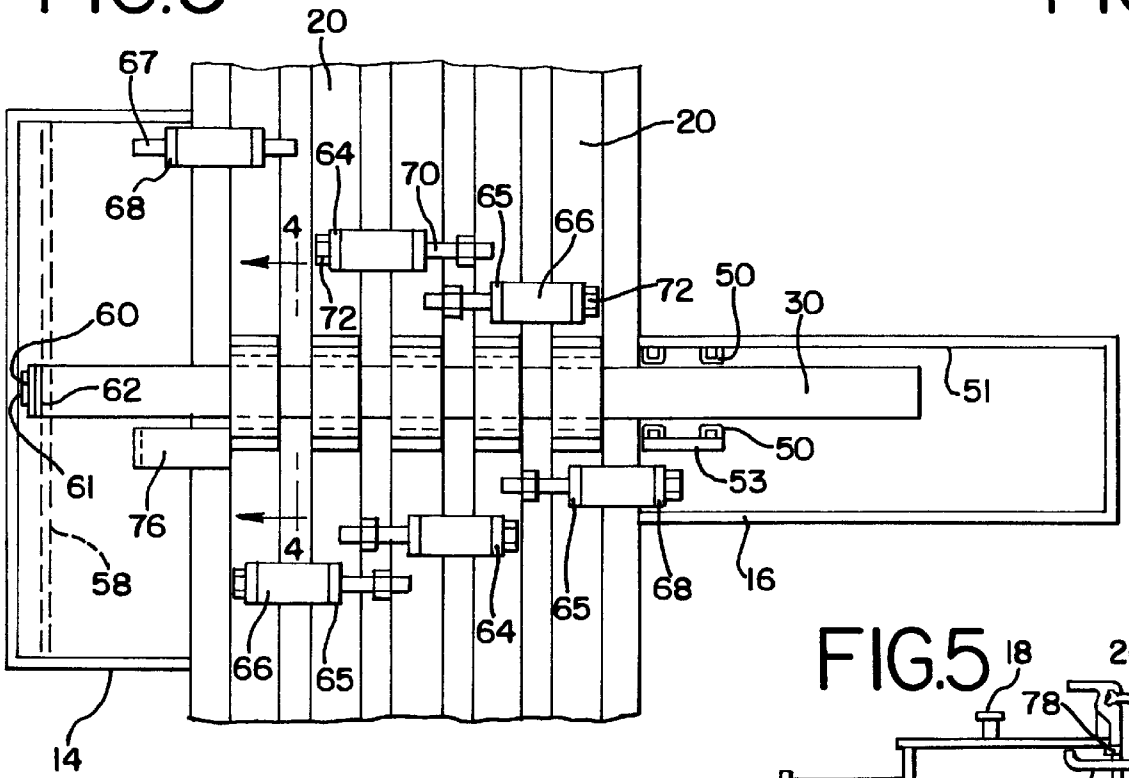
FIG. 3 is an enlarged fragmentary bottom plan view illustrating the components of the system.

FIGS. 2, 3 and 4 illustrate hold down devices which maintain the vertical relationship between the beams and bars. These devices include plates 32 which are welded to and extend downwardly from the beams 20. (FIG. 3 is a bottom plan view with the bottom walls of boxes 14 and 16 removed for ease of understanding. Accordingly, the cross-section illustrated in FIG. 4 is upside down). A U-shaped fitting 34 has its ends confined between the outer ends of plates 32 and welded thereto. Compression spring 36 is attached to the cross member 38 of the fitting 34 whereby the bars 30 are normally urged into contact with beams 20.

The compression spring 36 may be comprised of a commercially available polyurethane, laminated fabric defining a PTFE sliding surface 40. The opposite side of the bar 30 slides on a PTFE surface defined by element 41 which is received within and bonded to a recess defined by plate 43. Alternatively, a device similar to spring 36 could be used for engagement with this opposite side. Urethane shoes 42 are attached to the inside surfaces of the fitting side walls for maintaining alignment of the beams and bars.

Each box 16 comprises an elongated interior with bearing 44 attached to the bottom wall to facilitate longitudinal movement of a bar 30 within each box. Upper bearing and compression spring 48, which may be of the same type as spring 36, is also fixed to the box. The spring 48 thus urges the bars 30 in opposition to springs 36 of the hold down devices so that the bars are firmly maintained despite erratic movements caused by traffic and other conditions. As will be apparent, the bars 30 are free to move longitudinally between the respective bearings in response to expansion and contraction of the roadway and other movements. Shoes 50 (FIG. 3) serve to maintain the bars in alignment with one set of shoes mounted on box side wall 51 and the other on plate 53 which extends down from the box top wall to the box bottom wall.

Each box 14 defines a shorter and wider interior. In this case, composite bearings and compression springs 55 are preferably attached to each bar 30 and bearings 56, also attached to the bars, facilitate movement relative to the box upper and lower walls. As best shown in FIG. 3, the ends of the bars located within boxes 14 are not restrained against transverse movement. The bottom walls of the boxes, however, carry upstanding stops 58 attached thereto (FIGS. 2 and 3) and plates 60 mounted on the bar ends engage these stops to restrain the bars 30 from longitudinal movement relative to boxes 14. Urethane pads 61 or the like may be attached to the outer surfaces of plates 60 to act as a noise dampener. The inside portions of plates 60 which engage stops 58 may support a PTFE bearing or the like to facilitate transverse movement.

The system uses a buffer arrangement to achieve equidistant movement between beams in response to movements changing the longitudinal spacing between beams. As best shown in FIG. 3, holding plates 64 and 65 extend downwardly from and are attached to the bottom sides of adjacent beams 20. Urethane foam springs 66 are attached at their respective ends to the plates and the spring capacities will maintain spacing between the beams. Additional plates 68 are attached to the boxes 14 and 16 so that the outermost beams are also confined by the buffer arrangement.

Bolts 70 have their heads 72 welded to plates 68 which are attached to boxes 16 and to plates 64 which are attached to beams 20. A plate 65 is attached to a beam 20 adjacent to the position of plate 68, and adjacent to each beam carrying a plate 64. The bolts 70 extend through the springs 66.

The bolt heads 72 are located adjacent one end of springs 66 and the nuts 74 are welded to the bolts in spaced relationship to the plates 65 and the opposite ends of springs 66. The nylon dowels 67 between the plates 68 attached to the boxes 14 and the adjacent plates 64 do not carry restraining nuts. In operation, the springs 66, in a relaxed condition, will maintain equidistant openings between beams, for example, in the order of 80 mm. In response to contraction or other movement which increase the gap between the highway sections, the gaps between beams are controlled in "trailer hitch" fashion, that is, each beam when pulled to maximum separation, for example, 100 mm., will apply force to an adjoining beam and pull it to maximum separation, and so on. The seals 26 are designed to accommodate the separation limits.

Figure 5:
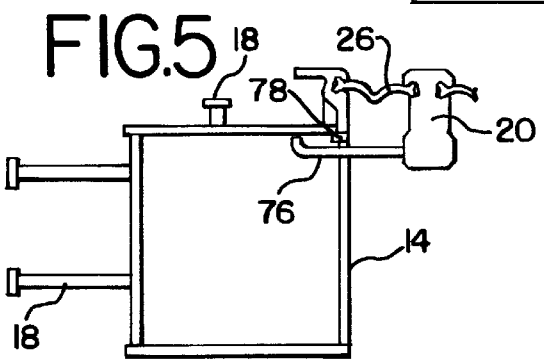

As shown in FIGS. 2, 3 and 5, the beam 20 adjacent box 14 has restraint bars 76 attached thereto for engagement with stop bars 78 attached to the boxes. This arrangement maintains the continuity of the "trailer hitch" buffer arrangement.

A seismic event could well involve forces causing one highway section to move transversely relative to the other section. In accordance with this invention, this condition can be accommodated by virtue of the manner in which the bars 30 are located in the system. Specifically, the bar ends are free to move transversely relative to boxes 14. All transverse components of seismic force is therefor accommodated, and the limits of movement imposed may be such that most, if not all, seismic events will not result in destruction of the system. In other words, few, if any, seismic events would interrupt the use of the highway structure due to damage of the expansion joint system.

It will be understood that various changes and additions may be made to the system of the invention without departing from the spirit of the invention particularly as described in the following claims.

That which is claimed:

1. An expansion joint system for highway construction wherein a gap is defined transversely between adjacent first and second highway sections, said system extending across the gap to permit vehicular traffic in a longitudinal direction, said system comprising a plurality of transversely extending, spaced-apart, beams having top surfaces exposed to the traffic, longitudinally extending support bars positioned beneath the beams for supporting the beams, first boxes positioned in the first highway section, each of said bars having one end located within one of the first boxes, means confining said one ends of the bars against transverse movement within a first box but permitting longitudinal movement within the box, second boxes positioned in the second highway section, and means confining the opposite ends of the bars against longitudinal movement within the second boxes but permitting transverse movement of the opposite ends within the second boxes.

2. An expansion joint system according to claim 1 including strip seals extending between the first and second boxes and beams adjacent thereto, and additional strip seals extending between beams adjacent to each other.

3. An expansion joint system according to claim 2 including means for controlling the spacing between beams during expansion and contraction of the gap between the highway sections.

4. An expansion joint system according to claim 1 including hold down devices connecting a beam to an underlying bar, and springs associated with the hold down devices urging the bars into engagement with the beams.

5. An expansion joint system according to claim 1 including vertical supports defined by said first boxes, and alignment shoes extending inwardly from said vertical supports to confine said one ends of said bar against transverse movement.

6. An expansion joint system according to claim 5 including stop members fixed to the bottom walls of said second boxes, and engagement means carried by said opposite ends of said bars for engaging said stop members to confine the opposite ends against longitudinal movement.

7. An expansion joint system according to claim 5 including spring means urging said one ends of said bars against the bottom walls of said first boxes, and bearing means positioned between said one ends and the box walls to facilitate longitudinal movement.

8. An expansion joint system according to claim 6 including spring means urging said opposite ends of said bars against the bottom walls of said second boxes, and bearing means positioned between said opposite ends and the bar walls to facilitate transverse movement.

* * * * *